US009111705B2

(12) United States Patent
Schulte

(10) Patent No.: US 9,111,705 B2
(45) Date of Patent: Aug. 18, 2015

(54) DEVICE AND METHOD FOR SWITCHING ELECTRICAL LOAD CIRCUITS

(71) Applicant: Daimler AG, Stuttgart (DE)

(72) Inventor: Sascha Schulte, Leinfelden (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 14/368,197

(22) PCT Filed: Oct. 6, 2012

(86) PCT No.: PCT/EP2012/004196
§ 371 (c)(1),
(2) Date: Jun. 23, 2014

(87) PCT Pub. No.: WO2013/091746
PCT Pub. Date: Jun. 27, 2013

(65) Prior Publication Data

US 2014/0347150 A1 Nov. 27, 2014

(30) Foreign Application Priority Data

Dec. 24, 2011 (DE) ..... 10 2011 122 439

(51) Int. Cl.
*H01H 9/00* (2006.01)
*H01H 36/00* (2006.01)
(Continued)

(52) U.S. Cl.
CPC ..... *H01H 36/0073* (2013.01); *H01H 3/001* (2013.01); *H01H 71/26* (2013.01); *H01H 50/546* (2013.01)

(58) Field of Classification Search
CPC ..... H01H 75/00
USPC ..... 335/174
See application file for complete search history.

(56) References Cited

U.S. PATENT DOCUMENTS 6,377,143 B1 * 4/2002 Zhou et al. ..... 335/132
6,943,654 B2 * 9/2005 Zhou et al. ..... 335/106
(Continued)

FOREIGN PATENT DOCUMENTS

DE 40 22 612 A1 2/1991
DE 199 47 105 A1 5/2001
(Continued)

OTHER PUBLICATIONS

International Search Report (PCT/ISA/220 & PCT/ISA210) dated Jan. 14, 2013 with English translation (eight pages).
(Continued)

*Primary Examiner* — Shawki S Ismail
*Assistant Examiner* — Lisa Homza
(74) *Attorney, Agent, or Firm* — Crowell & Moring LLP

(57) ABSTRACT

A device and method for switching electrical load circuits involve the use of an overload contact integrated in an exciting current circuit of a magnetic coil. The electrical load circuits include an electromagnetic contactor having a magnetic drive formed from a magnet yoke with a magnet coil and a magnet armature to which a contact bridge is coupled as a movable contactor contact by a contact retainer. In the switched-on state the contactor generates a magnetic retaining force for contacting the contact bridge with fixed contacts. The retaining force results from a magnetic field generated by the magnet coil, and the retaining force is greater than an armature opening force. The overload contact is integrated in the exciting current circuit of the magnet coil in such a manner that that when the exciting current circuit is closed and a movement of the contact bridge against the magnetic retaining force occurs, the magnet coil can be short-circuited by closing the overload contact.

9 Claims, 8 Drawing Sheets

Figure 1:
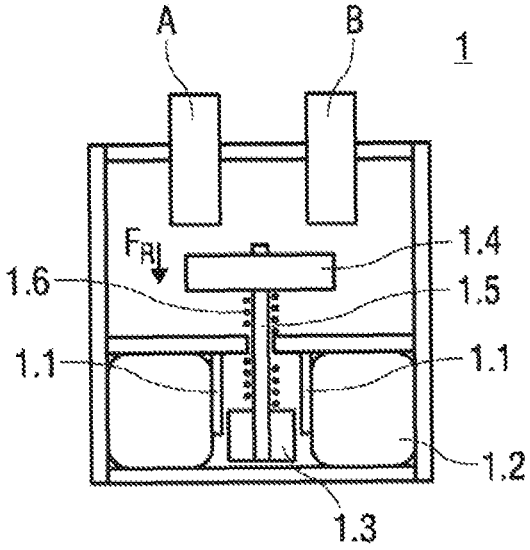
FIG 1 Prior art

(51) Int. Cl.

| | |
|---|---|
| ***H01H 3/00*** | (2006.01) |
| ***H01H 71/26*** | (2006.01) |
| *H01H 50/54* | (2006.01) |

(56) References Cited

U.S. PATENT DOCUMENTS

| | | | | |
|---|---|---|---|---|
| 6,956,728 | B2 * | 10/2005 | Zhou et al. | 361/160 |
| 6,968,859 | B1 * | 11/2005 | Nagano et al. | 137/554 |
| 8,193,882 | B2 * | 6/2012 | Murata et al. | 335/126 |
| 2003/0052756 | A1 | 3/2003 | Bollinger et al. | |
| 2007/0194867 | A1 * | 8/2007 | Kurasawa et al. | 335/126 |
| 2013/0093542 | A1 * | 4/2013 | Sora | 335/192 |

FOREIGN PATENT DOCUMENTS

| | | | |
|---|---|---|---|
| EP | 1 089 308 | A2 | 4/2001 |
| WO | WO 01/78210 | A1 | 10/2001 |
| WO | WO 2008/000200 | A1 | 1/2008 |

OTHER PUBLICATIONS

German-language Written Opinion (PCTI/SA/237) dated Jan. 14, 2013 (seven pages).

* cited by examiner

DEVICE AND METHOD FOR SWITCHING ELECTRICAL LOAD CIRCUITS

BACKGROUND AND SUMMARY OF THE INVENTION

Exemplary embodiments of the invention relate to a device and method for switching electrical load circuits, comprising an electromagnetic contactor having a magnetic drive that is formed from a magnet yoke with a magnet coil and a magnet armature to which a contact bridge is coupled as a movable contactor contact by means of a contact retainer, wherein in the switched-on state, the contactor generates a magnetic retaining force for contacting the contact bridge with fixed contacts, wherein the retaining force results from a magnetic field generated by the magnet coil, and the retaining force is greater than an armature opening force.

German patent document DE 199 47 105 C2 discloses a method and associated arrangements for switching electrical load circuits in which the respective load circuit comprises a contactor having a magnetic drive. The magnetic drive has a magnet yoke with a magnet coil and a magnet armature, to which bridge contacts are coupled as movable contactor contacts by means of a contact retainer, and which, in the switched-on state, generates a magnetic retaining force between the magnet yoke and the magnet armature, which retaining force is greater than an armature opening force. The method provides that as a welding protection for the bridge contacts of the contactor's magnetic drive an emergency switch-off takes place through which the value of the magnetic retaining force, during a time that is short with respect to the typical switch-off time of contactors, is lowered below the value of the armature opening time, for which reason an increase of the magnetic resistance in the iron core of the magnetic drive and a resulting decrease of the magnetic field of the coil is caused by a blocking magnetic field, whereby the contact bridge as contactor main contacts remain permanently open.

Exemplary embodiments of the present invention are directed to a device and a method for switching electrical load circuits, which are improved with respect to the prior art.

A device for switching electrical load circuits comprises an electromagnetic contactor having a magnetic drive formed from a magnet yoke with a magnet coil and a magnet armature to which a contact bridge is coupled as a movable contactor contact by means of a contact retainer. In the switched-on state the contactor generates a magnetic retaining force for contacting the contact bridge with fixed contacts, the retaining force results from a magnetic field generated by the magnet coil, and the retaining force is greater than an armature opening force. According to the invention, an overload contact is integrated in an exciting current circuit in such a manner that when the exciting current circuit is closed and a movement of the contact bridge against the magnetic retaining force occurs, the magnet coil can be short-circuited by closing the overload contact.

By means of the device according to the invention, a risk of overloading the contactor in the event of a fault in the load circuit, for example if the contactor is acted on by a short circuit current load that is a multiple of the rated current of the contactor, is advantageously at least reduced. The overload contact, by means of which the magnet coil can be short-circuited, avoids the occurrence of repeated opening and closing of the contacting between the contact bridge and the fixed contacts, which is referred to in the literature as electromagnetic repulsion, levitation or fluttering, as a result of which the contact bridge is welded to the fixed contacts due to arc formation between the contact bridge and the fixed contacts. Because of this, the contactor remains permanently closed even after turning off an exciting voltage, so that a device to be switched-off is unintentionally still loaded with a supply voltage.

Due to the fact that welding of the contact bridge to the fixed contacts can be largely excluded by means of the device, destruction of the contactor can be avoided and the contactor can be of further use.

Upon a first unintended magnetic lift of the contact bridge from the fixed contacts, the exciting current circuit can be deactivated so that another contacting of the contact bridge with the fixed contacts is avoided.

The overload contact is preferably formed by the contact retainer and a contact element, wherein the contact retainer has a first contact point that is located on a side facing away from the contact bridge, and the contact element has a second contact point, wherein the contact element is spaced apart from the contact retainer when the contact bridge is in contact with the fixed contacts and also in the switched-off state of the exciting current circuit. Due to the fact that the overload contact is formed in this manner, a separate current circuit is formed within the exciting current circuit. The effect of electromagnetic repulsion is always associated with a mechanical movement of the contact retainer together with the contact bridge and the magnet armature, wherein this movement is utilized in a particularly advantageous manner for arranging the contact points. Thus, in the event of a fault in the load circuit, the activation of the magnet coil can be interrupted, as a result of which the contactor is protected to the greatest possible extent against welding of the contact bridge to the fixed contacts.

In an advantageous configuration, the contact element as an integral part of the overload contact can be moved by means of the magnetic field generated by the magnet coil so that advantageously no further element for generating the movement of the contact element for short-circuiting the magnet coil is required.

In another particularly advantageous configuration, a switching unit is arranged between the overload contact and the magnet coil, by means of which switching unit closing of the overload contact after closing of the exciting current circuit and prior to a contacting of the contact bridge with the fixed contacts can be avoided. By means of the switching unit, which, for example, is formed at least by means of a thyristor, it can be avoided that the magnet coil, despite a closed overload contact, cannot be short-circuited. Thus, in first instance, a current flow for short-circuiting the magnet coil is prevented by means of the switching unit.

Preferably, a fuse or a semiconductor switching element, which disconnects an exciting voltage source from the magnet coil after activation of the overload contact, is arranged in the exciting current circuit. By means of the fuse or the semiconductor element it substantially avoids in a particularly advantageous manner the contactor being activated again once the effect of electromagnetic repulsion reoccurs after the contactor is completely switched-off and the exciting voltage is still applied. The fuse or the semiconductor switching element is tripped, as a result of which the exciting current circuit is intentionally interrupted.

In a possible embodiment, the armature opening force can be generated by means of at least one spring element, wherein the spring element can be pretensioned when the magnet coil is energized so that contacting takes place between the contact bridge and the fixed contacts, wherein the retaining force generated by means of the magnetic field, as described above, is greater than the armature opening force resulting from the pretension of the spring element.

The invention further relates to a method for switching electrical load circuits comprising an electromagnetic contactor having a magnetic drive that is formed from a magnet yoke with a magnet coil and an magnet armature to which a contact bridge is coupled as a movable contactor contact by means of a contact retainer, wherein in the switched-on state, a magnetic retaining force for contacting the contact bridge with fixed contacts is generated by means of the contactor, wherein the retaining force results from a magnetic field generated by the magnet coil, and the retaining force is greater than an armature opening force. According to the invention, an overload contact is integrated in an exciting current circuit in such a manner that when the exciting current circuit is closed and a movement of the contact bridge against the magnetic retaining force occurs, the magnet coil is short-circuited by closing the overload contact.

Particularly preferred, a contact element for forming the overload contact is moved by means of the magnetic field generated by the magnetic field.

BRIEF DESCRIPTION OF THE DRAWING FIGURES

Exemplary embodiments of the invention are explained below in greater detail with reference to the drawings.

Figure 2:
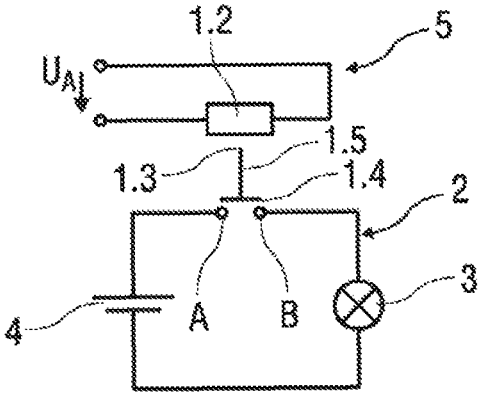
FIG 2 Prior art
Figure 3:
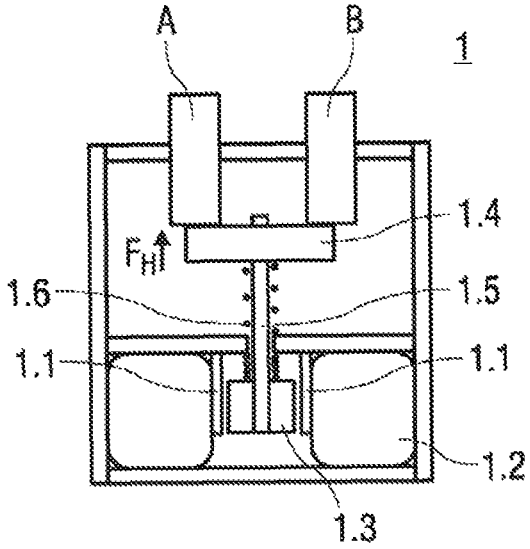
FIG 3 Prior art
Figure 4:
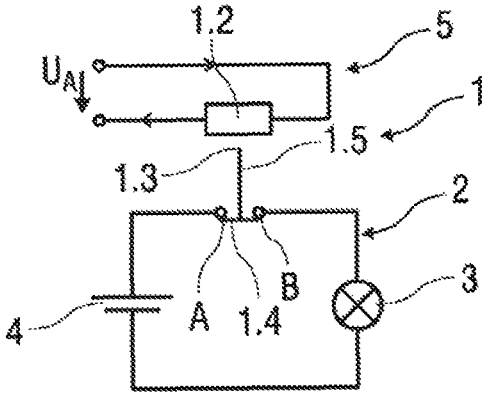
FIG 4 Prior art
Figure 5:
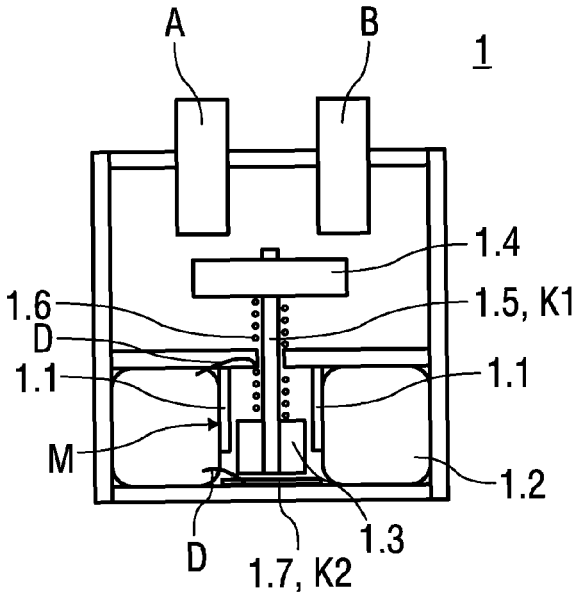
Figure 6:
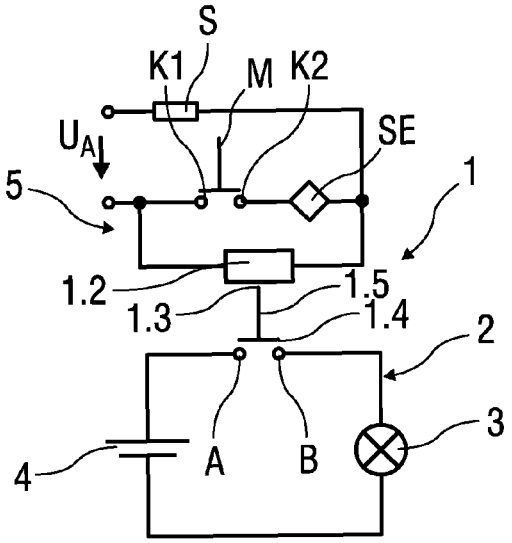
Figure 7:
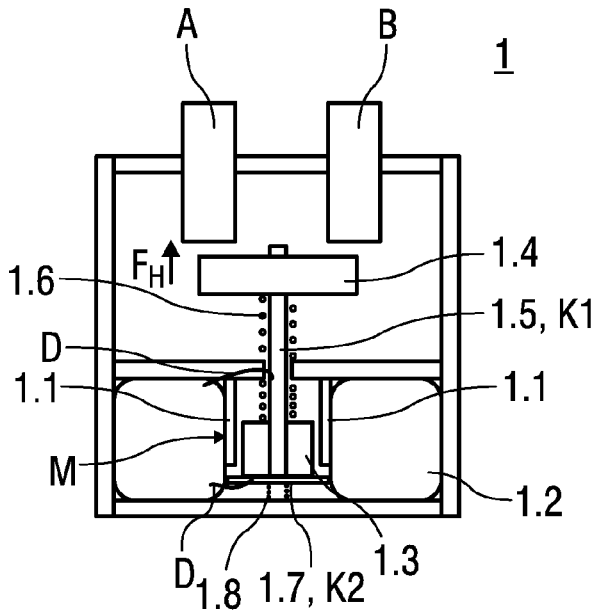
Figure 8:
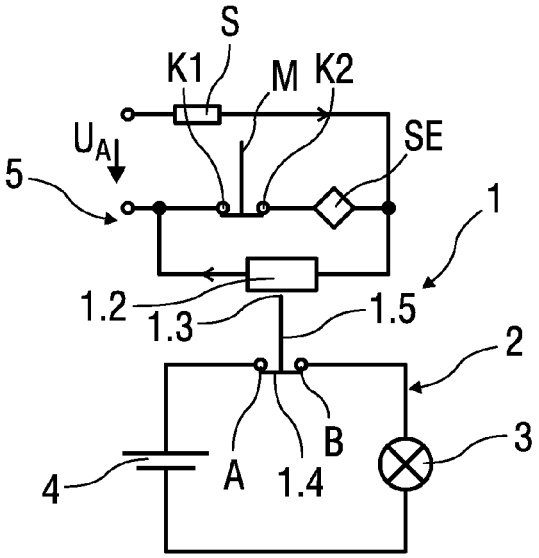
Figure 9:
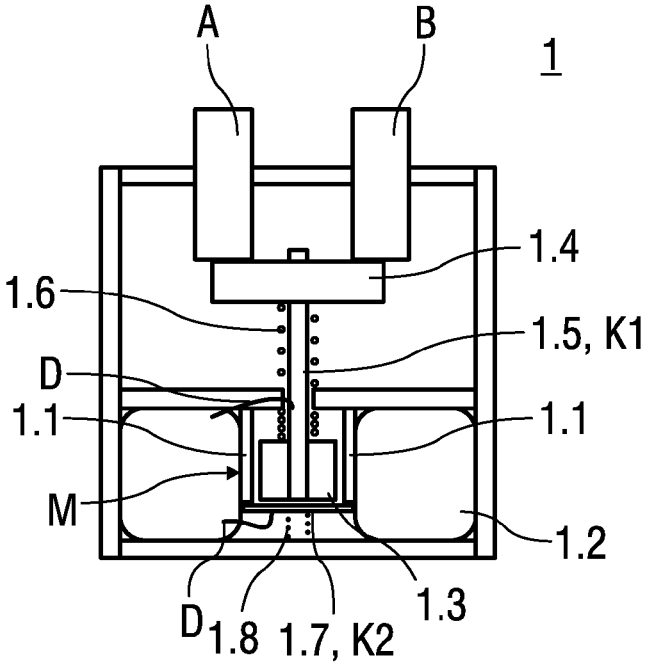
Figure 10:
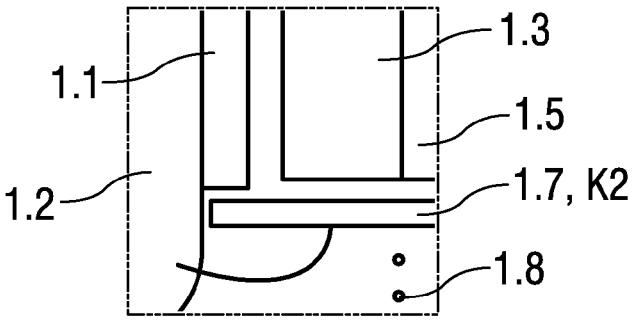
Figure 11:
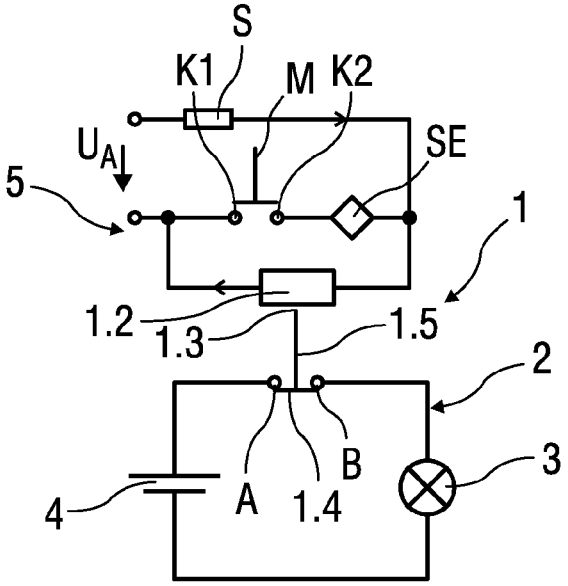
Figure 12:
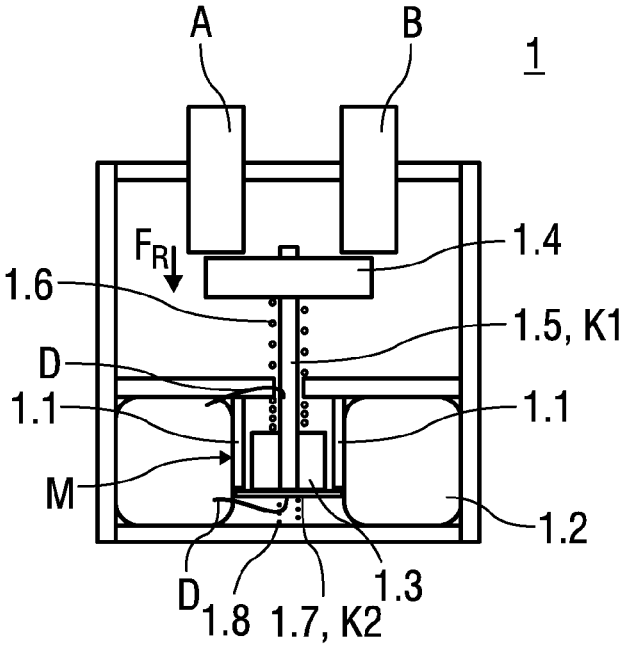
Figure 13:
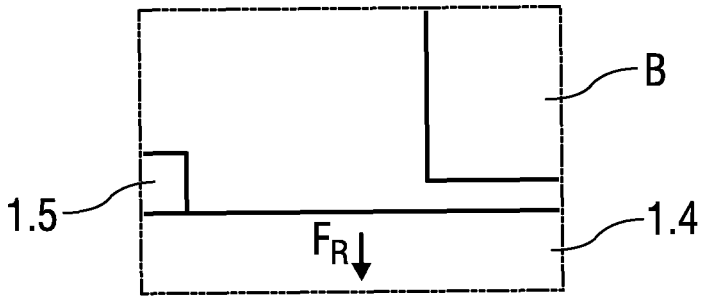
Figure 14:
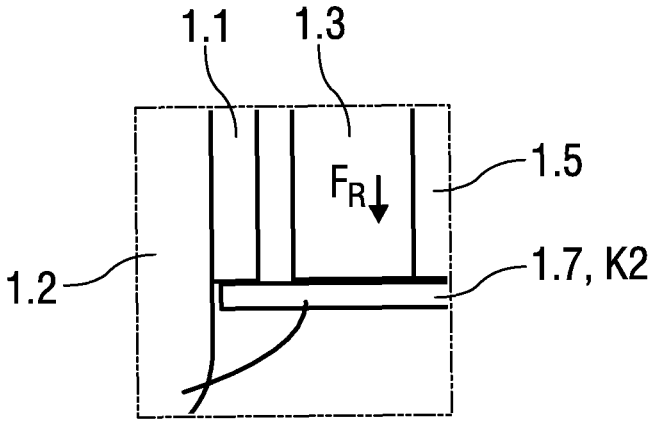
Figure 15:
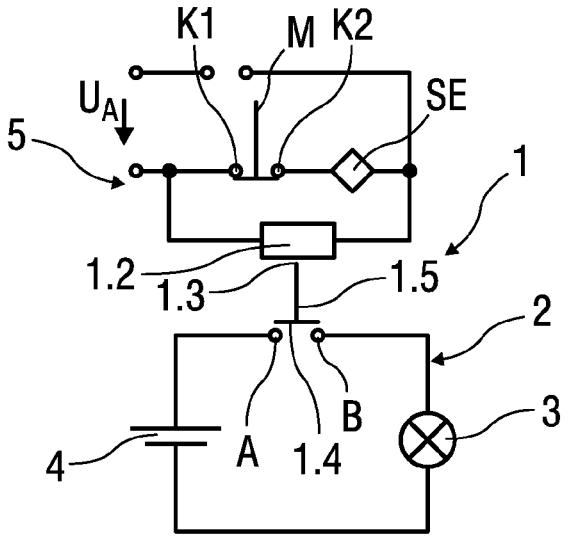
Figure 16:
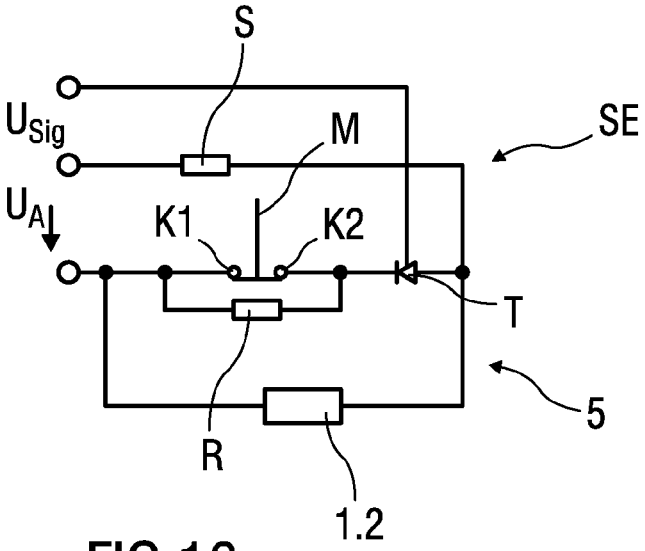

In the figures:

FIG. 1 schematically shows a sectional view of a contactor in the switched-off state, according to the prior art, FIG. 2 schematically shows an equivalent circuit diagram of the contactor in the switched-off state according to FIG. 1, FIG. 3 schematically shows the contactor according to the prior art in the switched-on state, FIG. 4 schematically shows an equivalent circuit diagram of the contactor in the switched-on state, FIG. 5 schematically shows a sectional view of a contactor in the switched-off state and an overload contact according to the invention, FIG. 6 schematically shows an equivalent circuit diagram of the contactor according to FIG. 5 with a closed protective circuit, FIG. 7 schematically shows a sectional view of the contactor in the switched-on state, and the overload contact, FIG. 8 schematically shows an equivalent circuit diagram of the contactor according to FIG. 7 and a closed protective circuit, FIG. 9 schematically shows a sectional view of the contactor in the switched-on state, with the overload contact and an open protective circuit, FIG. 10 schematically shows an enlarged detail of the contactor with a contact element that is spaced apart from a magnet armature, according to FIG. 9, FIG. 11 schematically shows an equivalent circuit diagram of the contactor according to FIG. 9 with open protective circuit, FIG. 12 schematically shows a sectional view of the contactor with a contact bridge that moves against a retaining force, FIG. 13 schematically shows a first enlarged detail according to FIG. 12, FIG. 14 schematically shows a second enlarged detail according to FIG. 12, FIG. 15 schematically shows an equivalent circuit diagram of the contactor according to FIG. 14 and an open protective circuit, and FIG. 16 schematically shows an equivalent circuit diagram of a possible embodiment of the protective circuit.

Parts that correspond to one another are designated in all Figures with the same reference numbers.

DETAILED DESCRIPTION

FIGS. 1 and 3 show a sectional view of an electromagnetic contactor 1, and FIGS. 2 and 4 each show an equivalent circuit diagram of the contactor 1 in a state according to the FIGS. 1 and 3.

The contactor 1 can be arranged in a load circuit 2 for switching a load, for example an electric consumer. Such a contactor 1 is arranged in a load circuit 2 of a vehicle having very low-ohmic energy sources, for example, a lithium-ion battery as a so-called high-voltage battery, and electric consumers. Here, the contactor 1 in FIG. 1 is illustrated in the switched-off state and in FIG. 3 in the switched-on state.

FIG. 2 shows an equivalent circuit diagram of the contactor 1 arranged in a load circuit 2, thus in a main current circuit with a light bulb 3 as the electric consumer, the contactor being in the switched-off state according to FIG. 1. Moreover, the load circuit 2, in which the contactor 1 is arranged, comprises a voltage source 4 for supplying electrical energy to the electric consumer in the form of the light bulb 3.

FIG. 4 shows an equivalent circuit diagram of the load circuit 2 with the contactor 1 in the switched-on state according to FIG. 3.

The contactor 1 has a magnetic drive with a magnet yoke 1.1, a magnet coil 1.2 and a magnet armature 1.3 on which a contact bridge is arranged as a movable contactor contact by means of a contact retainer 1.5. Moreover, the contactor 1 has two fixed contacts A, B which, in the switched-on state of the contactor 1, are contacted by means of the contact bridge 1.4, as illustrated in greater detail in FIG. 3. A retaining force $F_H$ results from a magnetic field generated by the magnet coil 1.2, wherein an exciting voltage $U_A$ is applied to the magnet coil 1.2 for generating the magnetic field.

If the exciting voltage $U_A$ is no longer applied to the magnet coil 1.2, thus, when the contactor 1 is switched-off, the magnet armature 1.3 with the contact retainer 1.5 and the contact bridge 1.4 arranged thereon is positioned into an open position by means of a first spring element 1.6 in the form of a spiral spring. In the open position, the contactor 1 is not switched-on so that the contact bridge 1.4 and the fixed contacts A, B are spaced apart from one another by a reset force $F_R$ of the spring element 1.6, as shown in FIG. 1. Here, the reset force $F_R$ is designated as armature opening force.

In the switched-on state of the contactor, as shown in FIG. 3, the contact bridge 1.4 is arranged at the fixed contacts A, B of the contactor 1, wherein the first spring element 1.6 is pretensioned when the magnet armature 1.3 moves with the contact retainer 1.5 and the contact bridge 1.4 in the direction towards the fixed contacts A, B. In the switched-on state of the contactor 1, the exciting voltage $U_A$ is applied to the magnet coil 1.2 via the two electrical connections thereof, which are not shown in detail, as a result of which the magnetic field is generated.

In the event of a fault in the load circuit 2, such a contactor 1 can be loaded with a short circuit load, thus an overload, which is a multiple of its rated current. Such currents can cause the contacts A, B, 1.4 inside the contactor 1 to be opened by electromagnetic forces. This means, the contact bridge 1.4 is lifted from the fixed contacts A, B by the reset force $F_R$ of the first spring element 1.6, thus by the armature opening force, which acts against the retaining force $F_H$, whereby the fixed contacts A, B and the contact bridge 1.4 are separated from one another.

Opening the contacts A, B, 1.4 can result in harmful arc formation. This arc can heat the contacts A, B, 1.4 up to a critical melting temperature. At the same time, a current reduction caused by the arc leads to a decrease of the electromagnetic forces, a decrease of the retaining force $F_H$ and thus to a reopening of the contacts A, B, 1.4. Subsequently, the contact bridge 1.4 engages again on the fixed contacts A, B, as a result of which contacting takes place again so that the fixed contacts A, B are connected to the contact bridge 1.4 in an electrically conductive manner. In the worst case, this unintentional opening and closing repeats multiple times in rapid alternation. This effect is referred to in the literature as electromagnetic repulsion, levitation or as fluttering.

Pressing the melted contacts A, B, 1.4 together again by pressing the contact bridge 1.4 by the retaining force $F_H$ onto the fixed contacts A, B causes them to be welded together so that the contactor 1 remains permanently closed even after the exciting voltage $U_A$ is switched-off and the load circuit 2 thus is still loaded with full supply voltage.

In order to be able to largely exclude the risk that the contact bridge 1.4 is welded to the fixed contacts A, B due to electromagnetic repulsion in the event of a fault in the load circuit 2, according to the invention an overload contact M is integrated in the exciting current circuit 5 of the magnet coil 1.2, as illustrated in greater detail in FIG. 5. By means of the overload contact M, the magnet coil 1.2 of the contactor 1 can be short-circuited if electromagnetic repulsion occurs.

With exciting voltage $U_A$ being applied to the magnet coil 1.2, the overload contact M is formed by means of two contact points K1, K2 that are connected via a wire D of the magnet coil 1.2 to the latter, as a result of which a separate current circuit is formed in the exciting current circuit 5 of the magnet coil 1.2.

A first contact point K1 of the overload contact M is formed by means of the contact retainer 1.5, and a second contact point K2 is formed by means of a contact element 1.7, wherein the first contact point K1 is arranged on the contact retainer 1.5 on a side facing away from the contact bridge 1.4.

The second contact point K2 forms the contact element 1.7 that can be disc-shaped and that is arranged parallel to the contact bridge 1.4 below the magnet yoke 1.1 and below the magnet armature 1.3.

If the contactor 1 is not switched-on, i.e., the contact bridge 1.4 is spaced apart from the fixed contacts A, B of the contactor 1, the contact element 1.7 and the magnet armature 1.3 are in an idle position, thus in a passive position.

FIG. 6 shows an equivalent circuit diagram of the exciting current circuit 5 of the magnet coil 1.2 of the contactor 1 with the overload contact M and the load circuit 2 in which the contactor 1 is arranged. Furthermore, a fuse S and a switching unit SE arranged between the magnet coil 1.2 and the overload contact M are located in the exciting current circuit 5, wherein the switching unit is illustrated in a possible embodiment in FIG. 16.

The fuse S serves for interrupting the exciting current circuit 5 of the magnet coil 1.2 by means of the overload contact M after the magnet coil is short-circuited. For this purpose, the fuse S is arranged between the switching unit SE and a first electrical connection of the magnet coil 1.2, wherein the switching unit SE is arranged between the fuse S and the overload contact M.

As an alternative to the use of the fuse S, a semiconductor switching element for interrupting the exciting current circuit 5 can also be arranged in the latter.

If exciting voltage $U_A$ is applied to the magnet coil 1.2, a current flow occurs, as a result of which a magnetic field is generated by means of the magnet coil 1.2. This magnetic field attracts the magnet armature 1.3 together with the contact retainer 1.5 and the contact bridge 1.4 in the direction towards the fixed contacts A, B, as illustrated in FIG. 7. Due to the fact that the overload contact M is closed by applying exciting voltage $U_A$ to the magnet coil 1.2, the contact element 1.7 is also magnetically activated, as a result of which it moves towards the magnet armature 1.3. Below the contact element 1.7, a second spring element 1.8 is arranged which is pretensioned when the contact element 1.7 moves towards the magnet armature 1.3.

Depending on the configuration of the contact bridge 1.4 and the contact element 1.7, the latter, due to its lower weight compared to the contact bridge 1.4, can move faster towards the magnet armature 1.3 than the contact bridge 1.4 moves towards the fixed contacts A, B. Because of this, the overload contact M can already be pressed against the magnet armature 1.3 during a switch-on phase of the magnet coil 1.2, thus of the contactor 1, as illustrated in FIG. 7. The state of the closed overload contact M in an equivalent circuit diagram is shown in FIG. 8 in the closed state.

In order to avoid that in this phase a coil current flowing through the magnet coil 1.2 is short-circuited by the closed overload contact M, the switching unit SE is arranged in the exciting current circuit 5, which is in an open switching state. Due to the fact that the switching unit SE is open, a short-circuiting current flow through the magnet coil 1.2 is prevented.

FIG. 9 shows the contactor 1 in the switched-on state so that the contact bridge 1.4 is arranged on the fixed contacts A, B and the load circuit 2 is closed.

A movement of the contact element 1.7 in the direction towards the magnet armature 1.3 is limited by means of the magnet yoke 1.1, which forms an iron core of the magnet coil 1.2, since the magnet yoke 1.1 is formed in such a manner that it forms a stop in the form of a mechanical lock for the contact element 1.7.

The contact element 1.7 is located at the stop formed by the magnet yoke 1.1 so that the contact element 1.7 has a predefinable distance from the magnet armature 1.3, as shown in detail in an enlarged section in FIG. 10. By defining the distance, when the contact bridge 1.4 is arranged on the fixed contacts A, B, between the magnet armature 1.3 and the contact element 1.7 resting against the magnet yoke 1.1, the sensitivity of the overload contact M as a protective mechanism for both the contactor 1 and the load circuit 2, in which the contactor 1 is arranged, can be set.

Due to the fact that the contact element 1.7 is not in contact with the magnet armature 1.3, the overload contact M is not closed, and the magnet coil 2 thus is not short-circuited.

FIG. 11 shows an equivalent circuit diagram of the exciting current circuit 5 of the magnet coil 1.2, wherein the load circuit 2, thus the main current circuit, is closed, and the overload contact M, as described above, is not closed. In this state, the switching unit SE is activated and consequently assumes a closed state. Due to the fact that the overload contact M is not closed, the activation of the switching unit SE initially has no consequences.

If electromagnetic repulsion occurs during the operation of the contactor 1, as illustrated in the FIGS. 12 and 13, unintentional lifting of the contact bridge 1.4 from the fixed contacts A, B takes place. Thus, the contact bridge 1.4 moves in the direction towards the magnet coil 1.2 and is deflected so far that the magnet armature 1.3 moves towards the contact element 1.7 resting against the magnet yoke 1.1 until the magnet armature 1.3 contacts the contact element 1.7. As a result, the overload contact M is closed, as shown in the equivalent circuit diagram according to FIG. 15.

The FIGS. 13 and 14 each show an enlarged detail, wherein in FIG. 13, the magnetic lifting of the contact bridge 1.4 from the fixed contacts A, B is illustrated, and in FIG. 14, closing of the overload contact M by contacting of the contact element 1.7 with the magnet armature 1.3 is illustrated.

Since the switching unit SE is activated, the magnet coil 1.2 is short-circuited upon closing of the overload contact M. The magnet coil 1.2 is no longer energized so that no magnetic field is generated, and the contact bridge 1.4 is moved by means of the contact retainer 1.5 and the contact armature 1.3 by the pretension of the first spring element 1.6 into the open position. In this position, the contact bridge 1.4 is spaced apart from the fixed contacts A, B, as in the switched-off state of the contactor 1.

Due to the fact that the overload contact M is closed upon occurrence of electromagnetic repulsion and thus the magnet coil 1.2 can be short-circuited, melting at the contact bridge 1.4 and the fixed contacts A, B as well as welding of the contact bridge 1.4 to the fixed contacts A, B by arc formation is avoided.

Upon a first process of magnetic lifting of the contact bridge 1.4 from the fixed contacts A, B, the exciting current circuit 5 of the magnet coil 1.2 of the contactor 1 is deactivated so that no magnetic field is generated and therefore the contact bridge 1.4 cannot be pressed against the fixed contacts A, B.

Depending on the configuration of the exciting current circuit 5 of the magnet coil 1.2, a short circuit path via the overload contact M and the switching unit SE can also short-circuit the exciting voltage $U_A$, which, however, can result in unwanted effects in the load circuit 2, thus in an external circuit. In order to avoid the unwanted effects, the fuse S or the semiconductor switching element is arranged in the exciting current circuit 5.

When short-circuiting the magnet coil 1.2 and also when short-circuiting the exciting voltage $U_A$, it is avoided that after the contactor 1 is completely switched-off while the exciting voltage $U_A$ is still applied, the contactor 1 is reactivated as soon as the contactor 1 is in its initial situation according to FIG. 5.

FIG. 16 illustrates a possible embodiment of the switching unit SE for blocking the current flow in the exciting current circuit 5 of the magnet coil 1.2.

The switching unit SE in the form of a control circuit of a protective circuit disables a premature activation of the overload contact M as a protective circuit through an electronic measure.

Principally, each standard circuit for electronic retaining circuits, both in analog and in digital form, is suitable as a switching unit SE.

FIG. 16 shows in detail the exciting current circuit 5 of the magnet coil 1.2 and the activated, i.e., the closed overload contact M. Moreover, a thyristor T and a high-impedance load resistor R are arranged in the exciting current circuit 5.

The thyristor T as a power-electronic standard component is configured in a neutral state so as to block the current flow in one direction so that the premature activation of the overload contact M can be avoided. By means of a signal pulse in the form of a voltage signal $U_{Sig}$, the thyristor T is activated, as a result of which the latter is set into a conductive state and the thyristor no longer blocks the current flow. This conductive state is automatically maintained as long as a predefined minimum current flows through the thyristor T.

With the overload contact M closed, this current is conducted through the high-impedance load resistor R, wherein it has to be considered that the current is so low that the exciting current circuit 5, i.e., the inductance of the magnet coil 1.2, is not affected.

By means of the overload contact M as the protective circuit within the load circuit 2 and the switching unit SE it is enabled that the contactor 1 reacts automatically and without delay to a mechanical movement, caused by the electromagnetic repulsion, of the magnet armature 1.3 as a switching process, whereby the magnet coil 1.2 of the contactor 1 is switched-off. In this manner it is substantially avoided that the contact bridge 1.4 is welded by arc formation to the fixed contacts A, B so that the exciting current circuit 5 remains permanently closed and the load circuit 2 to be switched-off still is loaded with its supply voltage.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

REFERENCE LIST

1 Contactor
1.1 Magnet yoke
1.2 Magnet coil
1.3 Magnet armature
1.4 Contact bridge
1.5 Contact retainer
1.6 First spring element
1.7 Contact element
1.8 Second spring element
2 Load circuit
3 Light bulb
4 Voltage source
5 Exciting current circuit
A Fixed contact
B Fixed contact
D Wire
M Overload contact
R Load resistor
S Fuse
SE Switching unit
K1 First contact point
K2 Second contact point
$F_H$ Retaining force
$F_R$ Reset force, armature opening force
$U_A$ Exciting voltage
$U_{Sig}$ Voltage signal
T Thyristor

The invention claimed is:

1. A device, comprising:

an electrical load circuit, which comprises an electromagnetic contactor having a magnetic drive formed from a magnet yoke with a magnet coil and a magnet armature to which a contact bridge is coupled as a movable contactor contact by a contact retainer, wherein in a switched-on state, the contactor is configured to generate a magnetic retaining force for contacting the contact bridge with fixed contacts, wherein the retaining force results from a magnetic field generated by the magnet coil, and the retaining force is greater than an armature opening force; and an overload contact integrated in an exciting current circuit of the magnet coil in such a manner that that when the exciting current circuit is closed and a movement of the contact bridge against the magnetic retaining force occurs, the magnet coil is short-circuited by closing the overload contact, wherein the overload contact is formed by the contact retainer and a contact element, wherein the contact retainer has a first contact point located on a side facing away from the contact bridge, and the contact element is spaced apart from the contact retainer when the contact bridge is in contact with the fixed contacts and also in the switched-off state of the exciting current circuit.

2. The device of claim 1, wherein when the contact bridge is in contact with the fixed contacts, the contact element rests against the magnet yoke.

3. The device of claim 1, wherein the contact element is moveable by the magnetic field generated by the magnet coil.

4. The device of claim 1, further comprising:

a switching unit arranged between the overload contact and the magnet coil, wherein the switching unit avoids closing the overload contact after closing the exciting current circuit and prior to contacting the contact bridge with the fixed contacts.

5. The device of claim 4, wherein the switching unit is formed from at least one thyristor.

6. The device of claim 1, further comprising:

a fuse or a semiconductor switching element arranged wherein in the exciting current circuit, the fuse or semiconductor switching element is configured to disconnect an exciting voltage source from the magnet coil after activating the overload contact.

7. The device of claim 1, further comprising:

at least one spring element configured to generate the armature opening force.

8. A method for switching an electrical load circuit comprising an electromagnetic contactor having a magnetic drive that is formed from a magnet yoke with a magnet coil and a magnet armature to which a contact bridge is coupled as a movable contactor contact by a contact retainer, the method comprising:

activating a switched-on state in which a magnetic retaining force for contacting the contact bridge with fixed contacts is generated by means of the contactor, wherein the retaining force results from a magnetic field generated by the magnet coil, and the retaining force is greater than an armature opening force, shorting-circuiting the magnetic coil by an overload contact, which is integrated in an exciting current circuit of the magnet coil, when the exciting current circuit is closed and a movement of the contact bridge against the magnetic retaining force occurs, wherein the overload contact is formed by the contact retainer and a contact element, wherein the contact retainer has a first contact point located on a side facing away from the contact bridge, and the contact element is spaced apart from the contact retainer when the contact bridge is in contact with the fixed contacts and also in the switched-off state of the exciting current circuit.

9. The method of claim 8, wherein the short-circuiting involves moving a contact element forming the overload contact by the magnetic field generated by the magnet coil.

* * * * *